US005511313A

United States Patent [19]

Yoder et al.

[11] Patent Number: 5,511,313

[45] Date of Patent: Apr. 30, 1996

[54] PNEUMATIC POWERED PINKING SHEARS

[75] Inventors: Patricia D. Yoder, 12950 E. Maple Ave. A14, Aurora, Colo. 80012; Andrew D. McGraw, Denver, both of Colo.

[73] Assignee: Patricia D. Yoder, Aurora, Colo.

[21] Appl. No.: 362,658

[22] Filed: Dec. 22, 1994

[51] Int. Cl.[6] ..... B26B 13/00

[52] U.S. Cl. ..... 30/228; 30/230

[58] Field of Search ..... 30/229, 230, 268, 30/254, 264

[56] References Cited

U.S. PATENT DOCUMENTS

| | | | |
|---|---|---|---|
| 947,626 | 1/1910 | Chapin | 30/268 |
| 2,492,121 | 12/1949 | Soderberg | 30/230 |
| 3,478,426 | 6/1967 | Greene . | |
| 3,621,572 | 11/1971 | Kruger . | |
| 3,668,780 | 6/1972 | Cowdrey . | |
| 3,698,086 | 10/1972 | Herr . | |
| 4,406,063 | 9/1983 | Zaitz . | |
| 4,967,474 | 11/1990 | Wells | 30/228 |

*Primary Examiner*—Douglas D. Watts

[57] ABSTRACT

An electric/pneumatic pinking shear with one touch button blade closure. The blades In these shears are shorter than previous blades because of the twisting and bending moments of long thin blades. The bending moments of the blades have been reduced so that shear tension between the blades can be kept to a minimum. The teeth on the blades are wider than other pinking shears in order to improve the quality of the finished cut. This will decrease the amount of thread unraveling after the fabric is cut.

13 Claims, 6 Drawing Sheets

KEY:

PNEUMATIC ————————

ELECTRICAL -·—·—·—·-

MECHANICAL ·····

PNEUMATIC POWERED PINKING SHEARS

BACKGROUND OF THE INVENTION

This invention relates to hand held power cutting tools in general, and most particularly to hand held, power assisted pinking shears for cutting a serrated edge in cloth or other fabric material.

The use of a pinking shear to obtain a saw-tooth or zigzag border or line of severance when cutting cloth fabric is a well known expedient to eliminate unraveling of the yarn or thread along the edges of certain materials that would occur when a straight edge cut is provided. Power pinking cutters are known in the art which provide a serrated rotating blade acting in cooperation with an anvil or backing member, but these suffer from the problem of not being able to finely control the rate of feed of the fabric being cut, thus resulting in inaccurately cut cloth.

Previous manual pinking shears have the deficiency of hurting the hand of the user, since pinking shears require much more hand strength than ordinary shears. An object of this invention is to provide a pair of pinking shears that are powered by an external power source, eliminating the need for such hand strength and the accompanying pain and fatigue. This will be especially appreciated by those persons who sew that are afflicted with arthritis in their hands. The power shears of the present invention will not hurt the hand becauses they are pneumatic, being operated by air pressure. Another object of the present invention is to provide for a powered pinking shear that permits the user to obtain an accurate cut the first, thus eliminating the need to re-cut the serrated edge, which can lead to premature unraveling and defeat the entire purpose of using a pinking shear. The teeth of the blades of the pneumatic pinking shear of the present invention are curved to provide smooth cutting action and minimal blade wear. The blades could easily be programmed to be milled on a modern CNC machine. The teeth on the blades are wider than other pinking shears in order to improve the quality of the finished cut. This will decrease the amount of thread unraveling after the fabric is cut.

Another object of the present invention is to eliminate any potential source of electrical spark that may cause fire in an environment that would be filled with flammable materials such as in a tailor shop or garment factory.

Yet another object of the present invention is to provide for a quiet power pinking shear that eliminates much of the noise associated with power pinking shears of the prior art.

SUMMARY OF THE INVENTION

In summary, the present invention comprises a power pinking device, which has a hollow casing; means for providing a source of compressed gas; pneumatic power drive means; a stationary lower cutting blade secured to the hollow casing, which lower cutting blade has a serrated cutting edge having a plurality of teeth of predetermined height; an upper movable cutting blade pivotally connected to said stationary blade and having a serrated cutting edge having a plurality of teeth of predetermined height, whose teeth are positioned to interdentate with the teeth of said lower cutting blade in a serrated shearing action; and means for operatively coupling said upper blade to said pneumatic power drive means for oscillation of said upper blade when said pneumatic power drive means is actuated.

DETAILED DESCRIPTION OF THE PREFERRED EMBODIMENTS

Figure 1:
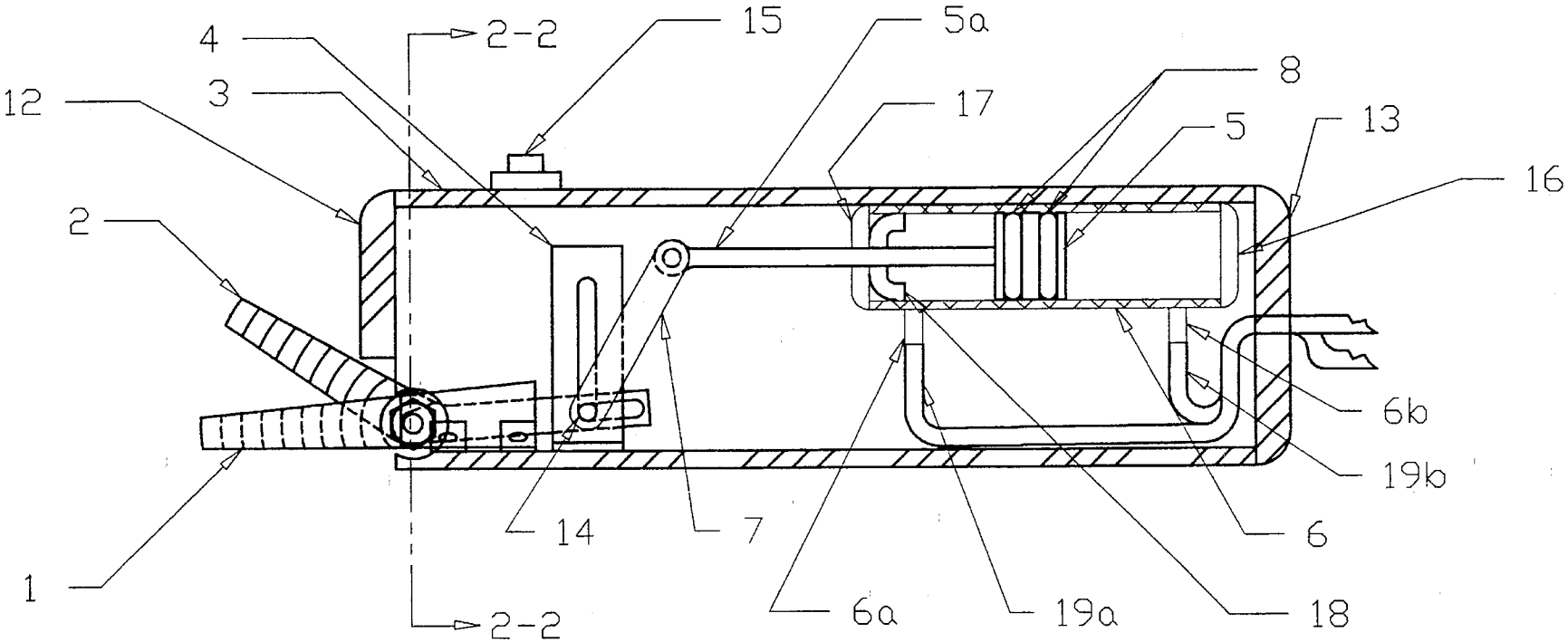
FIG. 1 is a partial cut-away side view, showing the overall layout of the components of the pneumatic pinking shears.
Figure 10:
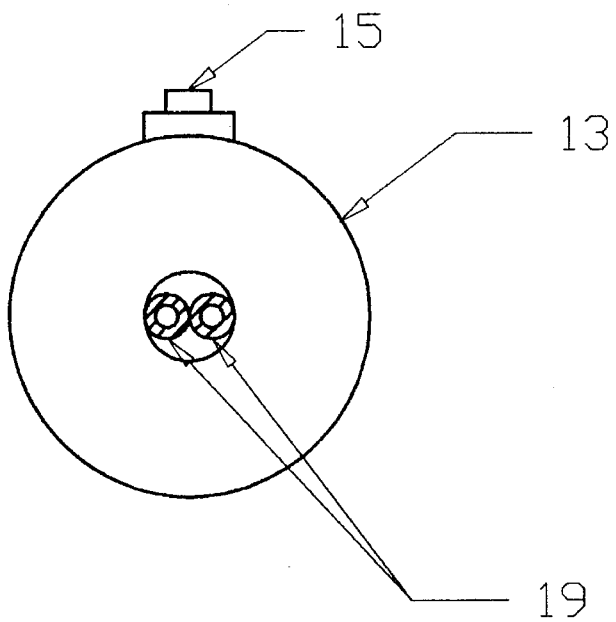
FIG. 10 is a rear view of the pneumatic pinking shears, showing the configuration of the inlet and outlet air hoses as they enter and exit the rear of the hollow casing.

At FIG. 1 there is shown an overall view of the components of the most preferred embodiment of the invention. The pneumatic pinking shears are housed within a hollow case 3. Case 3 is held in the hand of the user, who is able to activate the cutting action of the shears by pressing the control button 15. Case 3 is capped by front and rear case caps 12 and 13, respectively. Compressed air enters the shears via inlet hose 19*a* attached to inlet port 6*a*, acts upon piston 5 in cylinder 6, which pulls back upon connecting rod 5*a* and connecting arm 7 causing the rearwards portion of upper cutting blade 2 to rise forcing the forwards portion of upper cutting blade 2 down and shearing material against the cutting edges of lower cutting blade 1. On the return stroke, gas is exhausted through outlet port 6*b*, through exhaust hose 19*b*. Forward motion of piston 5 is limited by grommet 18. Relative positioning of intake and exhaust hoses through the end cap 13 is shown in FIG. 10.

Figure 2:
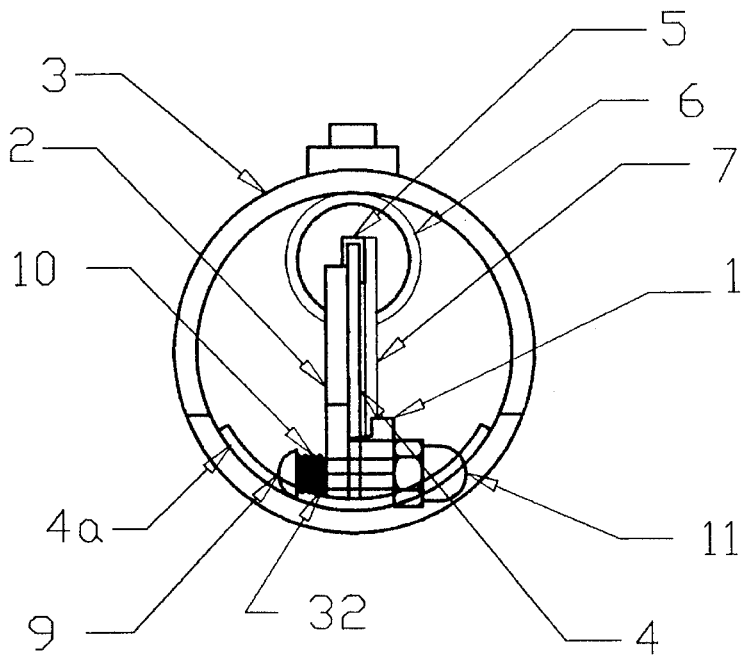
FIG. 2 is a front view of the shears in partial cut-away, showing the relative width configuration of the blades, the internal mechanism, and the tension adjustment screw and tension spring.

Another view of the relative positions of the internal components is provided in FIG. 2, which additionally show the means for providing adjustable tension of the cutting blades against each other. In this most preferred embodiment, a tensioning screw 9 is spring biased by spring 32 and held in place by suitable locking nut means 11. Shown in FIG. 2 by way of example is an acorn nut. In the most preferred embodiment, the tension adjustment screw is a size 6×¾" screw with a #6 low crown acorn nut. The screw is an American National Standard Slotted Round Head machine screw (ANSI B18.6.3-1972). A 0.020 wire diameter, 0.145 o.d., 25 coils per inch, 0.16 inch long, steel spring is used in conjunction with the screw to provide a shearing force of 3 pounds between the blades.

Figure 3:
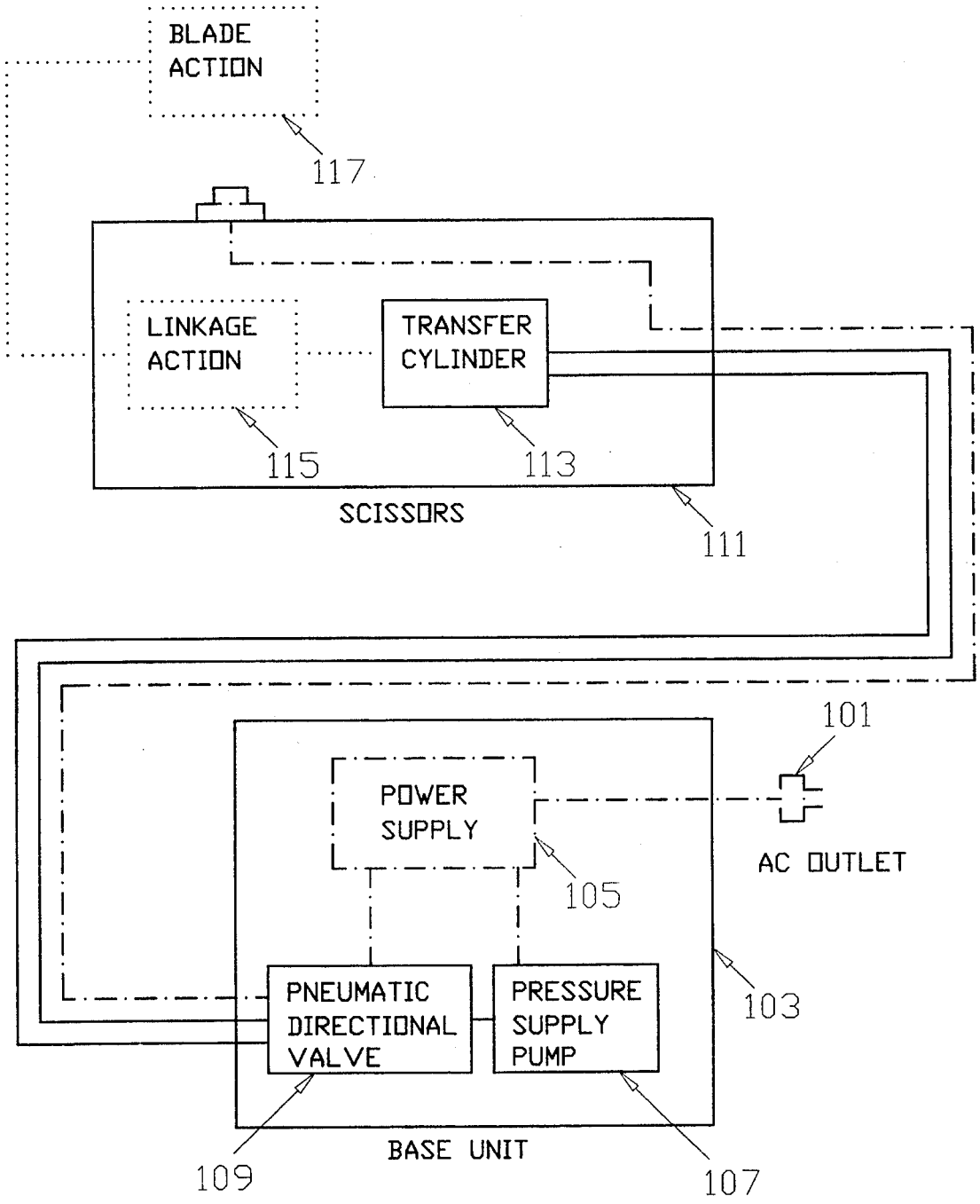
FIG. 3 is a schematic flow chart showing the operation of the device.

Turning to FIG. 3, a schematic flow chart, it can be seen that the base unit 103 contains a power supply, 105 for the activation switch, a four-way, remote air operated, inline double action pneumatic valve 109, and a pneumatic pump 107 or other source of compressed gas, which is readily available from several manufacturers, which will supply a most preferred pressure of 20 psi. The power supply 105 for the switch and the electrically powered pneumatic valve 109 is also readily available from manufacturers. These can be mounted into a base unit which will plug into a household wall outlet 101. The pneumatic air and electrical power supply box will be connected to the case by the two air hoses, each measuring ten feet long in the most preferred embodiment. Compressed gas released by valve 109 operates scissors 111 via transfer cylinder 113 through linkage action 115 to result in blade action 117.

Figure 7A:
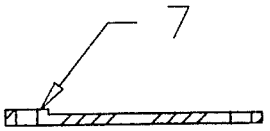
FIGS. 7 and 7*a* are the top view and the side views, respectively, of the piston connecting arm.
Figure 7:
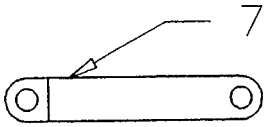
Figure 4:
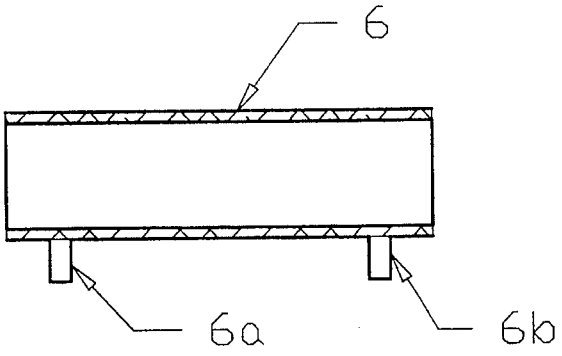
FIGS. 4 and 4*a* are the side and front views, respectively, of the piston cylinder showing the two inlet/outlet air hose attachments.
Figure 4A:
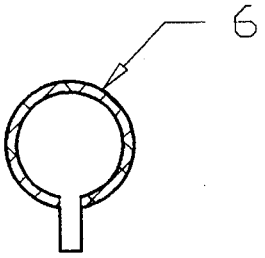

FIGS. 4 and 4*a* are the side and front views, respectively, of the piston cylinder 6 showing the two inlet/outlet air hose attachments, 6*a* and 6*b*, respectively, that are attached to intake and exhaust hoses 19*a* and 19*b*, respectively. With reference to FIGS. 1 and 4, the compressed air enters the chamber of piston cylinder 6 and forces the piston 5, via piston connecting rod 5*a*, to move the top end of connecting arm 7 to move down the guidance slot of slotted connecting arm guide 4. The upper cutting blade 2 is attached to the connecting arm 7 with a linkage pin 14. When air is forced into the chamber in front of the piston 5, it forces the rear of the upper cutting blade 2 upwards, which in turn forces the front of upper cutting blade 2 downward, which cuts the fabric. Additional details of connecting arm 7 are shown in FIGS. 7 and 7*a*

Figure 5:
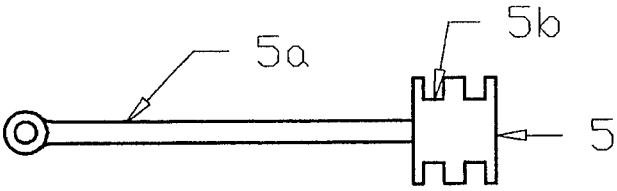
FIG. 5. is a side view of the piston with its connecting rod.
Figure 11A:
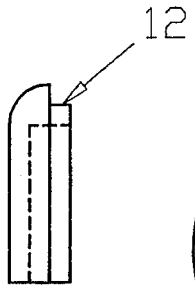
FIGS. 11 and 11*a* and are front and side views, respectively, of the front end cap of the hollow casing of the pinking shears.
Figure 11:
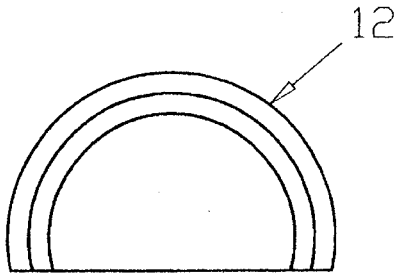
Figure 12A:
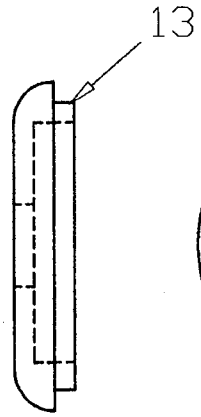
FIGS. 12 and 12*a* are front and side views, respectively, of the rear end cap of the hollow casing of the pinking shears.
Figure 12:
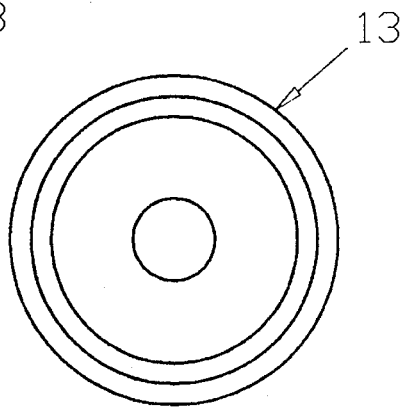
Figure 13A:
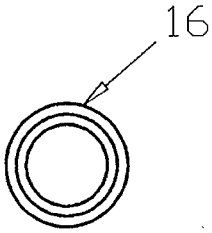
FIGS. 13 and 13*a* are front and side views, respectively, of the rear piston end cap.
Figure 13:
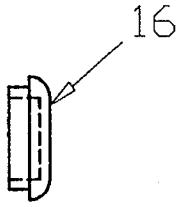
Figure 14A:
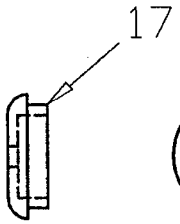
FIGS. 14 and 14*a* are front and side views, respectively, of the front piston end cap.
Figure 14:
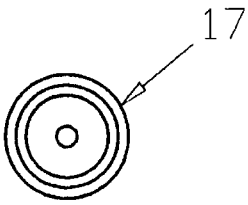

FIG. 5. is a side view of the piston 5 and piston connecting rod 5*a*, showing the annular grooves 5*b* for receiving one or more "O" rings, 8, which create an air-tight seal within the piston cylinder 6. Not shown is an oiling orifice for periodically adding sufficient lubricant to help maintain an airtight seal between the "O" rings and the piston cylinder walls.

Figure 6:
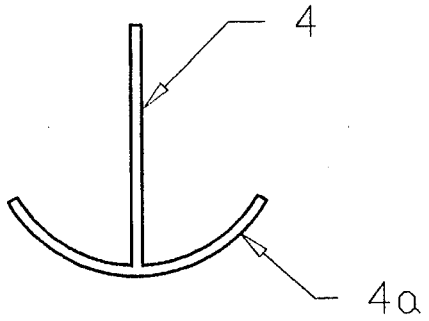
FIG. 6 is a side view of the slotted connecting arm guide support for the piston connecting arm.

FIG. 6 shows a front view of the slotted connecting arm guide 4. It can be seen that the guide 4 is perpendicular to its base 4*a*, which has an arc of curveture substantially similar to the inside curveture of the hollow case 3. This curveture helps to anchor the linkage components and this relationship is seen more clearly in FIG. 2.

Figure 9A:
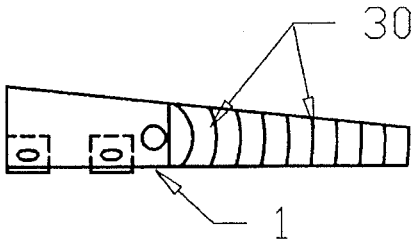
FIG. 9, 9*a* and 9*b* are the top, side and rear views, respectively, of the lower stationary cutting blade.
Figure 9B:
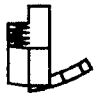
Figure 9:
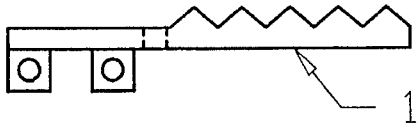
Figure 8A:
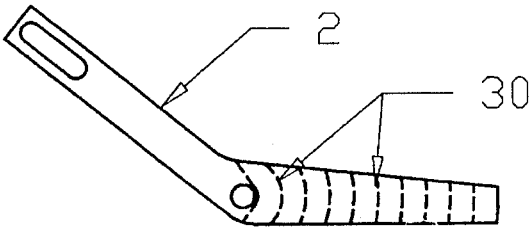
FIG. 8, 8*a* and 8*b* are the top, side and rear views, respectively, of the upper movable cutting blade.
Figure 8B:
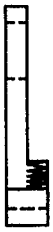
Figure 8:
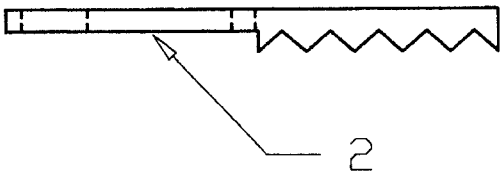

FIGS. 8, 8*a*, 9 and 9*a* show details of the cutting blades 1*b* and 2. The blades I and 2 of the pinking shears of the present invention are preferably made from steel. Current shears use only the front half of the blades when cutting fabric. The back half of the blades on current shears will not cut at all. The new blades of the present invention are shortened in order to facilitate a perpendicular shearing action over the approximately one and a half inch long cutting surface. Prior art blades had straight teeth and the problem of high friction wear was previously solved by having a gap between the blades at their base. The teeth of the blades of the present invention are radially curved through the height of their serrations to provide smooth cutting action and minimal blade wear. FIGS. 8*a* and 9*a* show the curvature of the cutting teeth at 30. It should be noted that as the teeth progress from the front to the rear of the cutting blade, the arc of the curviture decreases. Because of this progressive curvature, the blades fit together precisely without the gap found in previous scisssors. The blades are easily programmed to be milled on a modern CNC machine, the operation of which are well known to those in the machinists art.

While the invention has been described and illustrated with reference to certain preparative embodiments thereof, those skilled in the art will appreciate that various changes, modifications and substitutions can be made therein without departing from the spirit and scope of the invention. It is intended, therefore, that the invention be limited only by the scope of the claims which follow, and that such claims be interpreted as broadly as possible. In particular, it should be noted that the use of compressed gas in the operation of a pneumatic power source is only the most preferred embodiment of the invention. Any other source of oscillating motion that can actuate the disclosed linkage is within the contemplated scope of the invention.

What is claimed is:

1. A power pinking device, comprising:

(a) A hollow casing;

(b) means for providing a source of compressed gas;

(c) pneumatic power drive means;

(d) a stationary lower cutting blade secured to said hollow casing, which lower cutting blade has a serrated cutting edge having a plurality of teeth of predetermined height;

(e) an upper movable cutting blade pivotally connected to said stationary blade and having a serrated cutting edge having a plurality of teeth of predetermined height, whose teeth are positioned to interdentate with the teeth of said lower cutting blade in a serrated shearing action; and (f) means for operatively coupling said upper blade to said pneumatic power drive means for oscillation of said upper blade when said pneumatic power drive means is actuated, said means comprising a connecting rod having a distal end and a proximal end, which connecting rod is fixably attached to said piston at its proximal end; a connecting arm having a distal end and a proximal end; a slotted connecting arm guide; wherein said connecting rod defines a bore in its distal end for receiving a pin that permits movable attachment of said connecting arm hingeably with respect to said connecting rod; said connecting arm defines bores in both its distal and proximal ends for receiving pins that permit movable attachment of said connecting arm hingeably with respect to said connecting rod and with respect to said upper cutting blade; the movement of said connecting arm being constrained in a vertical path by the slot of said connecting arm guide.

2. The device as claimed in claim 1, wherein said upper and lower cutting blade teeth are radially curved through the height of their serrations.

3. The device as claimed in claim 2, wherein said teeth are radially curved through the height of their serrations, with the curvature arcs of the radii becoming progressively smaller, moving from the front to the rear of said cutting blades.

4. The device as claimed in claim 1, additionally comprising a finger or thumb controlled actuator movably attached to said hollow casing that allows a user of said device to control the flow of said compressed gas to said pneumatic power drive means, thereby controlling the rate by which said upper movable cutting blade oscillates and cuts fabric.

5. The device as claimed in claim 1, wherein said means for providing a source of compressed gas is a electrically powered air compressor.

6. The device as claimed in claim 1, wherein said pneumatic power drive means comprises a cylinder and piston.

7. The device as claimed in claim 6, additionally comprising intake and exhaust gas hoses.

8. The device as claimed in claim 6, wherein said piston has at least one annular groove for receiving an elastomeric gas seal.

9. The device as claimed in claim 8, wherein said elastomeric gas seal is a rubber O-ring.

10. The device as claimed in claim 9, having at least two rubber O-rings.

11. The device as claimed in claim 1, wherein said connecting arm guide comprises a vertical component defining said slot and is fixably attached perpendicularly to an arctuate base, whose arc of curviture is substantially the same as that of said hollow case.

12. The device as claimed in claim 1, additionally comprising means for adjusting shearing force between said stationary lower cutting blade and said movable upper cutting blade.

13. The device as claimed in claim 12, wherein said means for adjusting shear force comprises a spring biased screw secured by a suitable nut, said screw running through said pivotal connection between said upper and said lower cutting blades.

* * * * *